US009237641B2

(12) United States Patent
Suzuki et al.

(10) Patent No.: US 9,237,641 B2
(45) Date of Patent: Jan. 12, 2016

(54) ACCELERATING STRUCTURE

(71) Applicant: MITSUBISHI HEAVY INDUSTRIES, LTD., Tokyo (JP)

(72) Inventors: Daisuke Suzuki, Tokyo (JP); Sadao Miura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/024,865

(22) Filed: Sep. 12, 2013

(65) Prior Publication Data

US 2014/0125254 A1 May 8, 2014

(30) Foreign Application Priority Data

Nov. 7, 2012 (JP) ..... 2012-245315

(51) Int. Cl.

| | |
|---|---|
| ***H05H 9/00*** | (2006.01) |
| ***H05H 9/04*** | (2006.01) |
| ***H05H 7/16*** | (2006.01) |
| ***H05H 7/18*** | (2006.01) |
| ***H05H 7/22*** | (2006.01) |
| ***H05H 9/02*** | (2006.01) |

(52) U.S. Cl.

CPC . *H05H 9/04* (2013.01); *H05H 7/16* (2013.01); *H05H 7/18* (2013.01); *H05H 7/22* (2013.01); *H05H 9/02* (2013.01)

(58) Field of Classification Search

CPC ..... H05H 7/18; A61N 5/1049
USPC ..... 315/505
See application file for complete search history.

(56) References Cited

U.S. PATENT DOCUMENTS 5,698,949 A * 12/1997 Lien ..... H01J 25/02 315/5.31
6,126,149 A * 10/2000 Holtzman ..... F02M 5/08 261/69.1
6,376,990 B1 * 4/2002 Allen ..... H05H 9/04 315/111.61

(Continued)

FOREIGN PATENT DOCUMENTS

JP 45-4278 2/1970
JP 52-8800 1/1977

(Continued)

OTHER PUBLICATIONS

Office Action issued Aug. 26, 2014 in corresponding Japanese patent application No. 2012-245315 (with English translation).

(Continued)

*Primary Examiner* — Tung X Le
*Assistant Examiner* — Srinivas Sathiraju
(74) *Attorney, Agent, or Firm* — Wenderoth, Lind & Ponack, L.L.P.

(57) ABSTRACT

The present invention provides an accelerating structure capable of increasing a degree of vacuum at a middle part inside the accelerating structure while confining an alternating electric field to the inside. An accelerating structure 1 is formed of a plurality of annular discs 2 and 3 serially connected into a cylindrical shape. At least one of the discs 3 disposed at a middle part of the accelerating structure 1 includes: a choke structure formed by a choke filter 7; and a vacuum port 8 opened in an outer circumferential surface of the disc on an outer circumferential side radially outward from the choke structure, and the vacuum port 8 is connected to an external exhaust device.

2 Claims, 4 Drawing Sheets

(56) References Cited

U.S. PATENT DOCUMENTS

| | | | | |
|---|---|---|---|---|
| 6,407,505 | B1 * | 6/2002 | Bertsche | H05H 9/04 315/5.41 |
| 6,653,803 | B1 * | 11/2003 | DiVergilio | H05H 7/02 250/492.21 |
| 7,208,890 | B2 * | 4/2007 | Zavadtsev | H05H 7/00 315/5.41 |
| 7,339,320 | B1 * | 3/2008 | Meddaugh | H05H 9/048 315/5.41 |
| 8,258,725 | B2 * | 9/2012 | Ferguson | H01J 25/14 315/404 |
| 2004/0174949 | A1 * | 9/2004 | Yamashita | A61N 5/10 378/65 |

FOREIGN PATENT DOCUMENTS

| | | | | |
|---|---|---|---|---|
| JP | 55-146700 | | 11/1980 | |
| JP | 60-236499 | | 11/1985 | |
| JP | 4-69900 | | 6/1992 | |
| JP | 11-135299 | | 5/1999 | |
| JP | 11135299 | A * | 5/1999 | H05H 9/00 |
| JP | 2002-57000 | | 2/2002 | |
| JP | 2002-208500 | | 7/2002 | |
| JP | 2010-218747 | | 9/2010 | |

OTHER PUBLICATIONS

Extended European Search Report issued Jan. 16, 2014 in corresponding European patent application No. 13 18 6319.

T. Shintake et al., "HOM-Free Linear Accelerating Structure for $e^+e^-$Linear Collinder at C-Band", Proceedings PAC95, vol. 1, 1995 pp. 649-652.

Berra P. et al., "Study, construction and test of a 3GHz proton linac booster (LIBO) for cancer therapy", Proceedings of the 7th European Particle Accelerator Conference, Jun. 26 to 30, 2000, vol. 7, Aug. 24, 2000, pp. 2495-2497.

W. R. Fowkes et al., "An all-metal High Power Circularly Polarized X-Band RF Load", Proceedings of PAC97, vol. 3, 1997, pp. 3189-3191.

Decision to Grant a Patent issued Aug. 25, 2015 in corresponding Japanese patent application No. 2012-245315.

* cited by examiner

ACCELERATING STRUCTURE

CROSS-REFERENCE TO RELATED APPLICATIONS

This application is based on Japanese Patent Application No. 2012-245315, the contents of which are incorporated herein by reference.

TECHNICAL FIELD

The present invention relates to an accelerating structure applied to an accelerator which accelerates particles.

BACKGROUND ART

An accelerator is essentially equipped with: an accelerating structure which internally accelerates particles such as electrons, positrons, and protons; a klystron which supplies radio frequency for accelerating the particles to the accelerating structure; a waveguide which connects together the klystron and the accelerating structure; and a pulse compressor which amplifies the high-frequency power supplied to the accelerating structure.

The accelerating structure confines an alternating electric field to the inside thereof. The accelerating structure has an elongated hollow shape formed of a plurality of annular copper discs serially connected on a common axis. Coupler cells are connected to both ends (a most upstream part and a most downstream part) of the accelerating structure, and the coupler cells are coupled to the waveguide outside the accelerating structure.

Patent Literature 1 discloses a technology concerned with an accelerating structure which uses a choke mode cavity.

CITATION LIST

Patent Literature

{PTL 1}

Japanese Unexamined Patent Application, Publication No. Hei 11-135299

SUMMARY OF INVENTION

Technical Problem

In order to prevent velocity decay of elementary particles due to collision with gas and to prevent electric discharge due to an alternating electric field, the inside of the accelerating structure needs to be maintained at a high degree of vacuum. For this reason, an exhaust device is attached to the coupler cells provided at the both ends of the accelerating structure to evacuate the accelerating structure.

However, in a case of an accelerating structure with a length of more than 2 m, for example, the middle part inside the accelerating structure fails to be fully evacuated. On the other hand, if a through-hole for evacuation is provided on a side surface of the accelerating structure, the alternating electric field leaks from the through-hole, making it impossible to efficiently confine the alternating electric field.

The present invention has been made in view of the above situation, and an object thereof is to provide an accelerating structure capable of increasing a degree of vacuum at the middle part inside the accelerating structure while confining an alternating electric field to the inside.

Solution to Problem

According to the present invention, there is provided an accelerating structure formed of a plurality of annular discs serially connected into a cylindrical shape, in which at least one of the discs disposed at a middle part of the accelerating structure includes: a choke structure; and a first through-hole opening through an outer circumferential surface of the disc on an outer circumferential side that is radially outward from the choke structure, and the first through-hole is connected to an external exhaust device.

According to this configuration, since the disc has the choke structure, even where the first through-hole is provided in the outer circumferential surface of the disc, the alternating electric field does not leak from the first through-hole and there is no influence on the alternating electric field inside. Then, when the air inside the accelerating structure is exhausted using the external exhaust device, the air is exhausted also from the first through-hole formed in the disc disposed at the middle part of the accelerating structure. Thus, unlike a case where the inside air is exhausted only from the ends of the accelerating structure, the middle part inside the accelerating structure can also be fully evacuated.

Further, according to the present invention, there is provided an accelerating structure formed of a plurality of annular discs serially connected into a cylindrical shape, in which at least one of the discs disposed at a middle part of the accelerating structure includes: a choke structure; and aside from a second through-hole forming a beam bore provided on an axis, a third through-hole formed in a direction of the axis on an outer circumferential side that is radially outward from the choke structure, and when the inside air is exhausted from the ends of the accelerating structure, the air flows through the third through-hole.

According to this configuration, since the disc has the choke structure, even where the third through-hole is formed in the direction of the axis and radially outward from the choke structure, no electric field is formed in the third through-hole, and the alternating electric field can be kept confined to the inside of the accelerating structure. Then, when the air inside the accelerating structure is exhausted using the external exhaust device, the air is exhausted also from the third through-hole formed in the disc. Thus, unlike a case where the inside air is exhausted only from the second through-hole that forms the beam bore on the axis, the cross-sectional area of a flow path is larger, allowing the middle part inside the accelerating structure to be also fully evacuated.

According to the present invention, since the through-hole for the air to flow through is formed in at least one of the discs disposed at the middle part of the accelerating structure, and the through-hole is located on the outer circumferential side radially outward from the choke structure, it is possible to increase the degree of vacuum at the middle part inside the accelerating structure while confining the alternating electric field to the inside.

DESCRIPTION OF EMBODIMENTS

Hereinbelow, embodiments of the present invention will be described with reference to the drawings.

First Embodiment

A first embodiment of the present invention will now be described using FIGS. 1 and 2.

An accelerating structure 1 is applied to an accelerator (not shown), and accelerates particles such as electrons, positrons, and protons by internally forming an alternating electric field. The accelerator is, for example, a C-band accelerator having a resonance frequency of 5712 MHz. The accelerator is essentially equipped with: the accelerating structure 1; a klystron (not shown) which supplies radio frequency for accelerating the particles to the accelerating structure 1; a waveguide (not shown) which connects together the klystron and the accelerating structure 1; and a pulse compressor (not shown) which amplifies the high-frequency power supplied to the accelerating structure 1. Note that the accelerating structure 1 according to the present embodiment can be applied not only to the C-band accelerator but also to an S-band accelerator or the like, for example.

Figure 1:
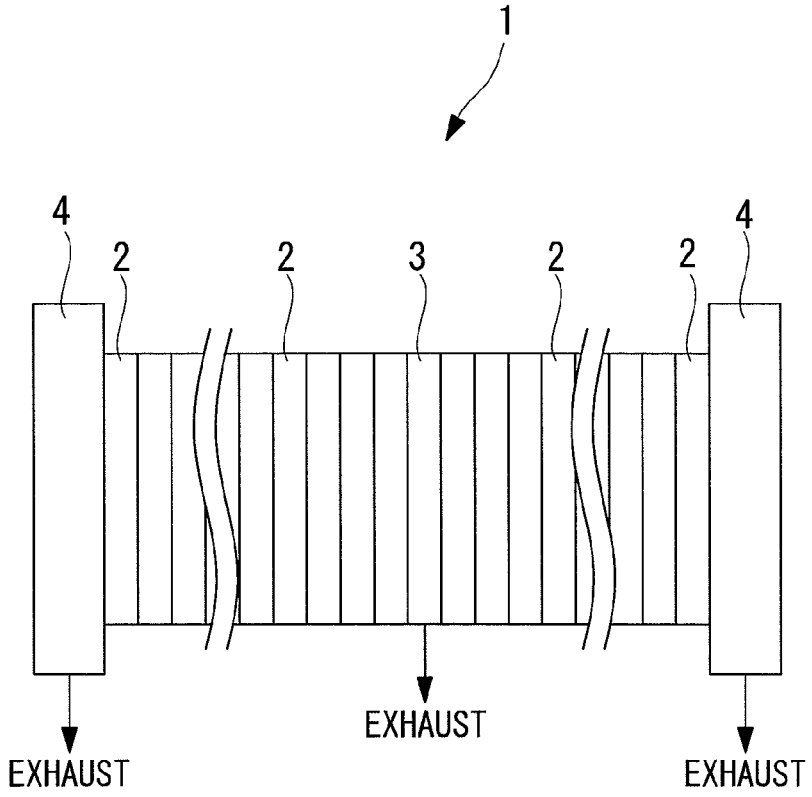
FIG. 1 is a schematic side view of an accelerating structure according to a first embodiment of the present invention.
Figure 2:
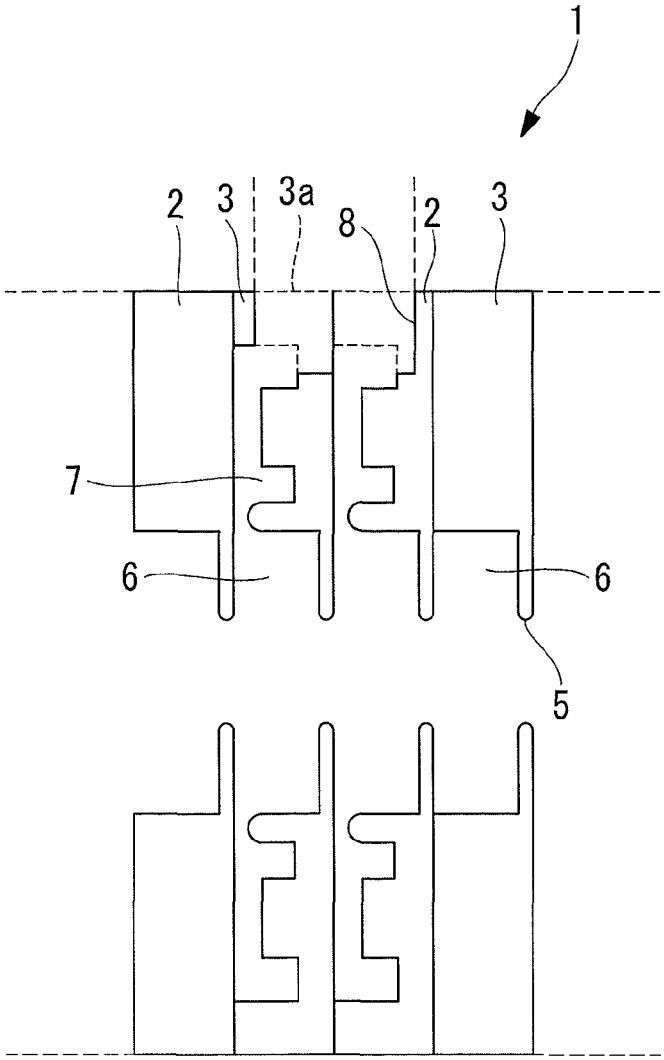
FIG. 2 is a partially enlarged, longitudinal cross-sectional view of the accelerating structure according to the first embodiment of the present invention.

As shown in FIG. 1, the accelerating structure 1 is formed of a plurality of, e.g., about 80 to 100 discs 2 and 3 serially connected into a substantially cylindrical shape, and has a length of more than 2 m, for example. Coupler cells 4 are connected to the both ends of the accelerating structure 1. The coupler cells 4 are coupled to the waveguide outside the accelerating structure. In addition, a vacuum pump (not shown) is attached to the coupler cells 4 through a pipe (not shown) to evacuate the accelerating structure.

The discs 2 and 3 are made of oxygen-free copper and joined together. Joining methods of the discs 2 and 3 include brazing, EBW (electron-beam welding), diffusion bonding, electroforming, and the like. As shown in FIG. 2, the discs 2 and 3 are formed with a beam bore 5 on a central axial part. The accelerated particles pass through the beam bore 5. By serially connecting the discs 2 and 3 on the common axis, a linear route for the particles to pass through is formed at the axial part of the accelerating structure 1.

The disc 2 has an acceleration cavity 6 provided by making a plate thickness of a portion around the beam bore 5 thinner than that of an outer circumferential portion.

The discs 3 are disposed at a middle part of the accelerating structure 1. Of the serially connected plurality of discs 2 and 3, at least one disc is the disc 3. The disc 3 has the acceleration cavity 6 provided by making a plate thickness of a portion around the beam bore 5 thinner than that of other portions. In addition, the disc 3 is provided with a choke filter 7, which has a plate thickness thinner than that of the other portions, and is positioned on the outer circumferential side radially outward from the acceleration cavity 6.

Since the choke filter 7 is provided, when an alternating electric field is formed in the accelerating structure 1, the electric field is prevented from being formed in a radial direction of the disc 3.

A vacuum port 8 is provided in a side surface 3*a* of the disc 3 in the radial direction. The vacuum port 8 is located on the outer circumferential side radially outward from the choke filter 7. The vacuum port 8 is connected to a vacuum pump (not shown) through a pipe (not shown). When the air inside the accelerating structure 1 is exhausted using the vacuum pump, the air flows through the vacuum port 8.

Figure 4:
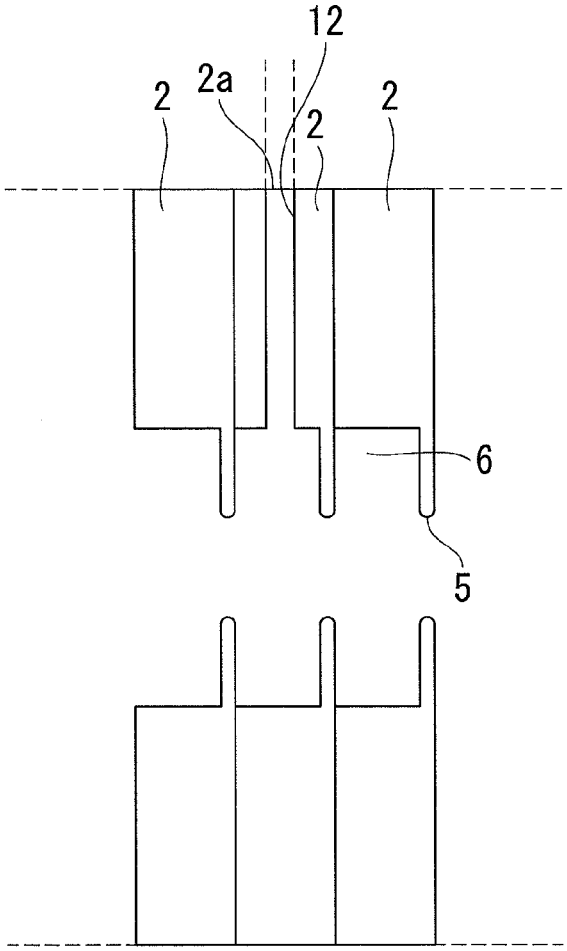
FIG. 4 is a partially enlarged, longitudinal cross-sectional view of an accelerating structure according to a reference example.

As in a reference example shown in FIG. 4, assuming that a vacuum port 12 is provided in a side surface 2*a* of the disc 2 which has no choke structure, the electric field leaks from the vacuum port 12, making it impossible to efficiently form an alternating electric field inside the accelerating structure 1. On the other hand, in the present embodiment, since the disc 3 is provided with the choke filter 7 and has the choke structure, even where the vacuum port 8 is provided in the side surface 3*a* of the disc 3, the electric field does not leak from the vacuum port 8 and there is no influence on the alternating electric field inside.

Then, when the air inside the accelerating structure 1 is exhausted using the external vacuum pump, the air is exhausted also from the vacuum port 8 formed in the disc 3 disposed at the middle part of the accelerating structure 1. Therefore, unlike a case where the inside air is exhausted only from the ends of the accelerating structure 1, the middle part inside the accelerating structure 1 can also be fully evacuated.

Thus, according to the present embodiment, the degree of vacuum can be improved across the accelerating structure 1 in the longitudinal direction, which enables the operation in a high electric field.

Second Embodiment

Figure 3:
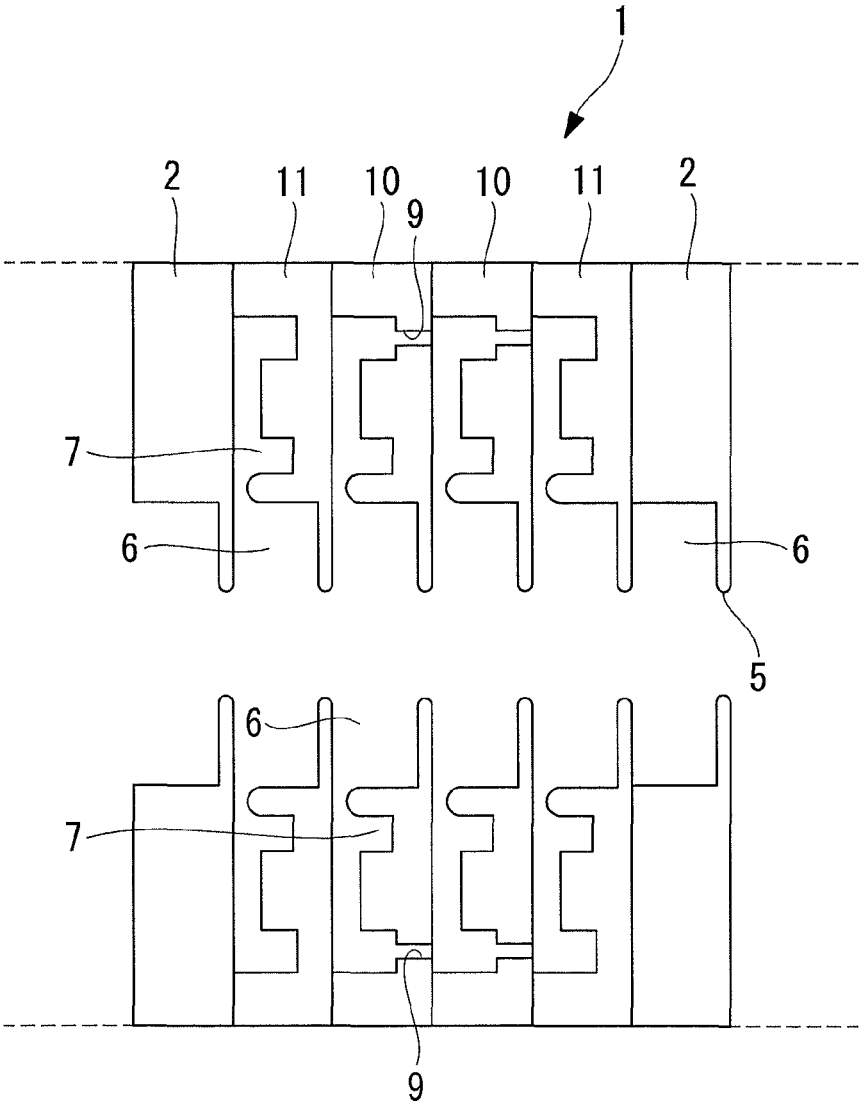
FIG. 3 is a partially enlarged, longitudinal cross-sectional view of an accelerating structure according to a second embodiment of the present invention.

Next, a second embodiment of the present invention will be described using FIG. 3. For configurations and effects overlapping with those of the first embodiment, a detailed description will be omitted.

In the above first embodiment, the case has been described where the vacuum port 8 is provided in the side surface 3*a* of the disc 3 to exhaust the air at the middle part of the accelerating structure 1. In this embodiment, discs 10 and 11 are provided instead of the discs 3, and a flow path 9 is formed in the direction of the axis of the disc 10 aside from the beam bore 5. The following is a description of the discs 10 and 11 according to the present embodiment.

The discs 10 and 11 are disposed at the middle part of the accelerating structure 1. Each of the discs 10 and 11 has the acceleration cavity 6 provided by making a plate thickness of a portion around the beam bore 5 thinner than that of other portions. In addition, each of the discs 10 and 11 is provided with a choke filter 7, which has a plate thickness thinner than that of the other portions, and is positioned on the outer circumferential side radially outward from the acceleration cavity 6.

Since the choke filter 7 is provided, when an alternating electric field is formed in the accelerating structure 1, the electric field is prevented from being formed in the radial direction of the discs 10 and 11.

The flow path 9 is an opening part formed in the disc 10 and provided in the direction of the axis and on the outer circumferential side radially outward from the choke filter 7. In this embodiment, the disc 10 is provided with the flow path 9, while the disc 11 is not provided with the flow path 9. When the inside air is exhausted from the ends of the accelerating structure 1 using the vacuum pump, the air flows through the flow path 9. In this embodiment, of the plurality of serially connected discs 2, 10, and 11, at least one disc is the disc 10 and at least one disc is the disc 11. However, by serially arranging the discs 10, a long air flow path is formed in the direction of the axis, which allows the air to efficiently flow toward the ends of the accelerating structure 1.

Since the disc 10 is provided with the choke filter 7 and has the choke structure, even where the flow path 9 is formed in the direction of the axis and on the outside radially outward from the choke structure, no electric field is formed in the flow path 9, and the alternating electric field can be kept confined to the inside. Then, when the air inside the accelerating structure 1 is exhausted using the external vacuum pump, the air is exhausted also from the flow path 9 formed in the disc 10. Therefore, unlike a case where the inside air is exhausted only from the beam bore 5 formed on the axis, a cross-sectional area of the flow path in a plane perpendicular to the direction of the axis is larger, allowing the middle part inside the accelerating structure 1 to be also fully evacuated.

Thus, according to the present embodiment, the degree of vacuum can be improved across the accelerating structure 1 in the longitudinal direction, which enables the operation in a high electric field.

Note that the disc 10 of the second embodiment may be provided not only with the flow path 9 but also with the vacuum port 8 described in the first embodiment. This causes the air to flow in two directions during evacuation and allows the air to be exhausted more efficiently from the middle part inside the accelerating structure 1.

The invention claimed is:

1. An accelerating structure formed of a plurality of annular discs serially connected into a cylindrical shape, wherein at least one disc of the discs is disposed at a middle part of the accelerating structure and comprises:

a choke structure; and a first through-hole that is formed, aside from a second through-hole formed on an axis of the one disc, in a radial direction of the one disc, from a portion closer to an outer circumferential surface of the one disc than the choke structure to the outer circumferential surface, and that penetrates-through the one disc itself, wherein the first through-hole is connected to an external exhaust device at the outer circumferential surface.

2. An accelerating structure formed of discs serially connected into a cylindrical shape, wherein each of a plurality of discs, among the discs, disposed at a middle part of the accelerating structure comprises:

a choke structure; and a third through-hole that is formed aside from a second through-hole formed on an axis of the disc, in a direction of the axis, and that penetrates through the disc itself at a predetermined portion closer to an outer circumferential surface of the disc than the choke structure, wherein:

the plurality of discs are serially arranged to align circumferential positions of the third through-holes formed in the plurality of the discs.

* * * * *